US011738837B1

(12) United States Patent
Fratus

(10) Patent No.: US 11,738,837 B1
(45) Date of Patent: Aug. 29, 2023

(54) COMPACT TORPEDO RECOVERY SYSTEM

(71) Applicant: The United States of America as represented by the Secretary of the Navy, Newport, RI (US)

(72) Inventor: Timothy M Fratus, North Kingstown, RI (US)

(73) Assignee: The United States of America as represented by the Secretary of the Navy

( * ) Notice: Subject to any disclaimer, the term of this patent is extended or adjusted under 35 U.S.C. 154(b) by 225 days.

(21) Appl. No.: 17/471,254

(22) Filed: Sep. 10, 2021

(51) Int. Cl.

| | |
|---|---|
| ***B63C 7/26*** | (2006.01) |
| ***B63C 7/02*** | (2006.01) |
| ***B63B 1/04*** | (2006.01) |
| ***F42B 19/38*** | (2006.01) |

(52) U.S. Cl.
CPC ..... *B63C 7/02* (2013.01); *B63B 1/04* (2013.01); *B63C 7/26* (2013.01); *F42B 19/38* (2013.01)

(58) Field of Classification Search
CPC .... B63C 7/02; B63C 7/26; B63B 1/04; B63B 22/08; F42B 19/38; F42B 19/44
See application file for complete search history.

(56) References Cited

U.S. PATENT DOCUMENTS

| | | | | |
|---|---|---|---|---|
| 1,587,514 | A * | 6/1926 | Duncan | B63C 7/26 114/51 |
| 1,643,247 | A * | 9/1927 | La Grange | B63C 7/02 114/51 |
| 2,752,615 | A * | 7/1956 | Parker | B63C 9/24 102/407 |
| 3,934,865 | A * | 1/1976 | Wedrall | B63C 7/26 200/34 |
| 4,319,372 | A * | 3/1982 | Tausig | B63C 7/02 192/93 C |
| 5,803,780 | A | 9/1998 | Gutierrez | |
| 6,123,593 | A | 9/2000 | Mercer | |
| 6,383,045 | B1 | 5/2002 | Eckardt | |
| 6,390,012 | B1 | 5/2002 | Watt | |
| 6,739,924 | B1 | 5/2004 | Groen | |
| 7,000,560 | B2 | 2/2006 | Wingett | |
| 7,232,353 | B1 | 6/2007 | Gauthier | |
| 8,448,592 | B2 | 5/2013 | Crowell | |
| 2002/0157299 | A1 * | 10/2002 | Barrett | A01M 31/06 43/3 |
| 2013/0233232 | A1 | 9/2013 | Crowell | |
| 2014/0162509 | A1 * | 6/2014 | Harrington | B63C 7/26 441/6 |

* cited by examiner

*Primary Examiner* — Andrew Polay
(74) *Attorney, Agent, or Firm* — James P. Kasischke; Michael P. Stanley

(57) ABSTRACT

A torpedo recovery system is provided with a hull and a float conformable on a host vehicle and lifting wire coiled on a spool attached by an extension spring as well as with an anchor to the float. An oval hole penetrates the recovery system hull at positions lined with a watertight sleeve. The spool can accommodate a locking pin. The extension spring allows compliance for take-up of the spool by having the locking pin mate with an aperture and adds a wire pre-tension. Upon vehicle shutdown; the locking pin is retracted to free the spool from a rotational constraint. The float buoyancy translates into pulling the wire from the spool with the float and extension spring continuing to the water surface. Once the float reaches the surface; the float provides a visual location for the host vehicle. The float is retrieved and a winch can recover the lightweight torpedo.

6 Claims, 2 Drawing Sheets

COMPACT TORPEDO RECOVERY SYSTEM

STATEMENT OF GOVERNMENT INTEREST

The invention described herein may be manufactured and used by or for the Government of the United States of America for Governmental purposes without the payment of any royalties thereon or therefor.

CROSS REFERENCE TO OTHER PATENT APPLICATIONS

None.

BACKGROUND OF INVENTION

(1) Field of the Invention

The present invention is directed to a recovery system for lightweight torpedoes and vehicles.

(2) Description of Prior Art

Research and development of torpedoes requires underwater testing and recovery. Many lightweight torpedoes are so tightly packaged that the torpedoes are negatively buoyant and will sink once the torpedoes stop moving. As such, recovery of the torpedo is essential.

A popular recovery system for lightweight torpedoes uses inflatable buoyancy bags to add buoyancy upon shutdown of the power plant of the torpedo in order to raise the torpedo or the vehicle to the surface. This system or other buoyancy systems use either very high-pressure nitrogen gas or hot gas generators to inflate the buoyancy bags. These systems are very expensive to construct due to their complicated hull geometry, numerous high tolerance parts and the technical support needed to maintain and operate the systems.

Furthermore, buoyancy systems are dangerous due to the extremely high gas pressure or the use of an explosively hot gas generator. Also, buoyancy systems are complicated designs requiring compensating valves, pressure regulators, check valves and numerous fittings in which there is risky reliability due to the numerous parts which must function flawlessly in order for the buoyancy system to operate.

Additionally, bulky gas systems take up a lot of volume due to a spherical high-pressure gas flask, a large valve stack and a deflated bag volume. Even so, these gas systems have a low lifting capacity that is only a fraction of the dry weight of the torpedo.

Consequently, most development torpedoes are weight-limited even when there is room to add more components due to the inability of the recovery system to raise the overloaded vehicle. Also, if the buoyancy bags fail to inflate, divers or robotic recovery vehicles must be sent down to recover the torpedo at great expense. As such, a simple, safe, relatively small and inexpensive recovery system is needed for lightweight torpedo testing.

SUMMARY OF THE INVENTION

The Compact Lightweight Torpedo Recovery System (CLTRS) of the present invention includes an affixable hull, a float, a spool, a spool locking assembly, high strength wire wound on the spool, an extension spring and a torsion spring (located in the spool). An arrangement of the male joint and the female joint on the hull allows for the insertion of the CLTRS along the length of the host vehicle for adequate trim and weight of the host vehicle.

An oval hole penetrates the hull at two positions and is lined with a watertight pressure sleeve. The oval hole or aperture can be flooded with seawater while the rest of the hull can be dry. The oval hole accommodates the float, the spool, the high strength wire, the extension spring and the locking part of the spool locking assembly. Only one hole penetrates the wall of the watertight pressure sleeve to accommodate the spool locking assembly.

The lifting wire is attached to the spool to provide a high strength connection. The length of the wire is coiled onto the spool and terminates with a connection to the extension spring.

The extension spring is attached to an eyelet on the underside of the float via an anchor cast well inside the float. The extension spring allows compliance for take-up of the spool. This permits the locking pin to mate with one of the holes in the spool and adds a pre-tension to keep the wire tightly wound.

In operation and after receiving an electrical signal from the host vehicle upon vehicle shutdown; a locking pin is retracted to free the spool from a rotational constraint. The buoyancy of the float will translate into wire tension; thereby, pulling the wire from the spool with the float continuing to the water surface. The initial unspooling of the wire from the spool is assisted by a torsion spring attached to the spool shaft within the spool.

Once the float reaches the water surface; the float provides a visual location of the host vehicle. The float can then be retrieved with the float and the extension spring removed from the high strength wire and coiled on a winch. The winch then slowly lifts the lightweight torpedo to the water surface for recovery.

The novel recovery system of the present invention has a more reliable and less complicated design. Fewer parts and a simpler design reduce the risk of malfunction. Current recovery systems use complicated depth pressure adjusting valves to not over-inflate and rupture the bags, pressure transducers, check valves and many other fittings that are susceptible to failure.

The novel torpedo recovery system has the same diameter as existing lightweight recovery systems but is only six inches in length. As such, the recovery system length is much shorter than existing systems. The length reduction decreases the amount of recovery system weight and increases the allowable weight limit for the same length vehicle due to increased lifting capacity.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein like reference numerals and symbols designate identical or corresponding parts throughout the several views and wherein.

DETAILED DESCRIPTION OF THE INVENTION

The Compact Lightweight Torpedo Recovery System (CLTRS) 10 can recover a 12.75 inch lightweight size torpedo after a run without the use of divers, compressed air or lift bags. The CLTRS 10 also uses a third of the volume required by present recovery systems. The CLTRS 10 further has greater capacity by lifting over three times the weight of current systems due to the preferably 0.09 inch diameter high strength lifting wire and simpler inner component configuration. Unlike current recovery designs, the inner component configuration is not depth sensitive.

Figure 1:
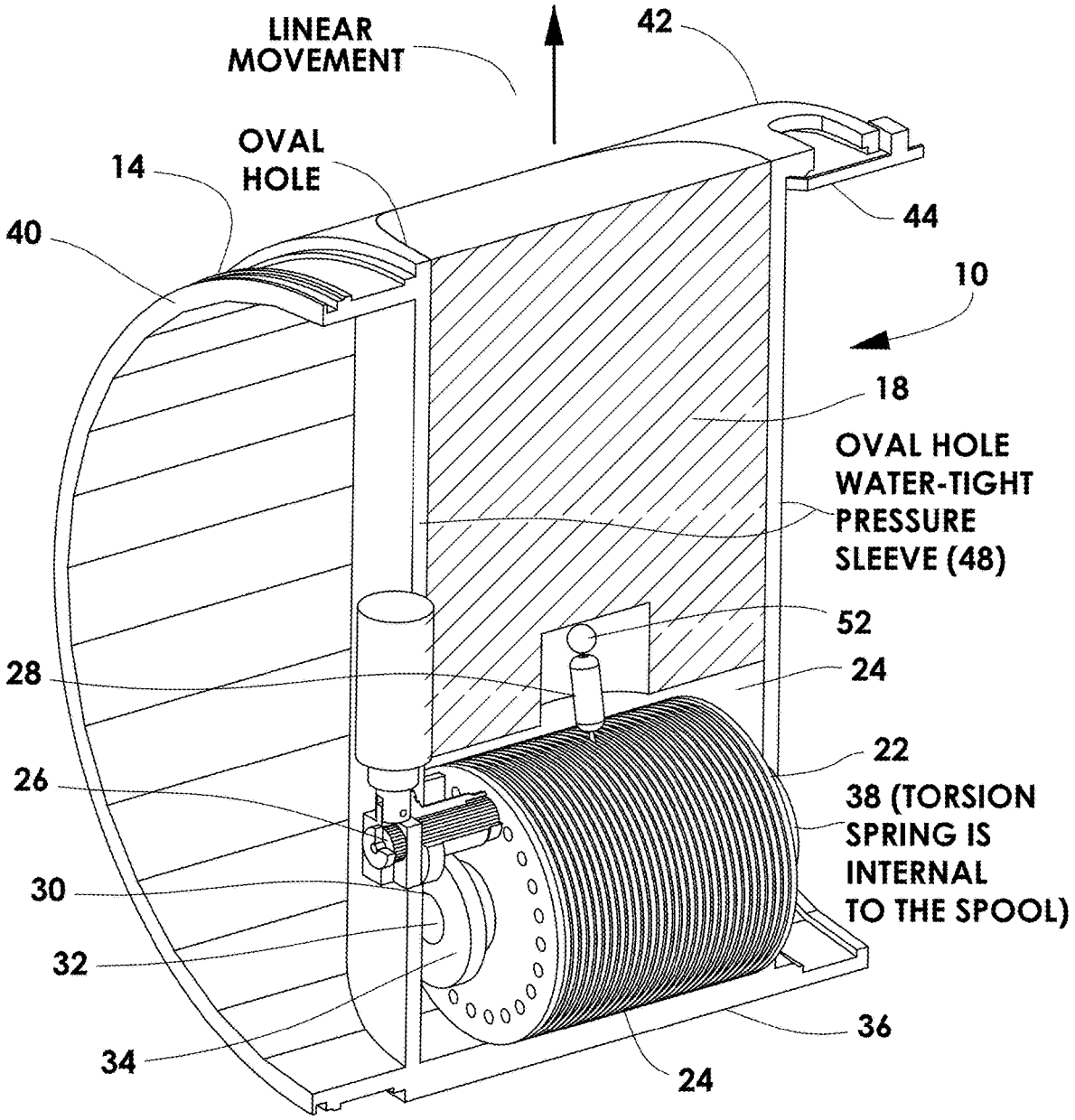
FIG. 1 depicts an isometric view of the compact lightweight torpedo recovery system of the present invention.
Figure 2:
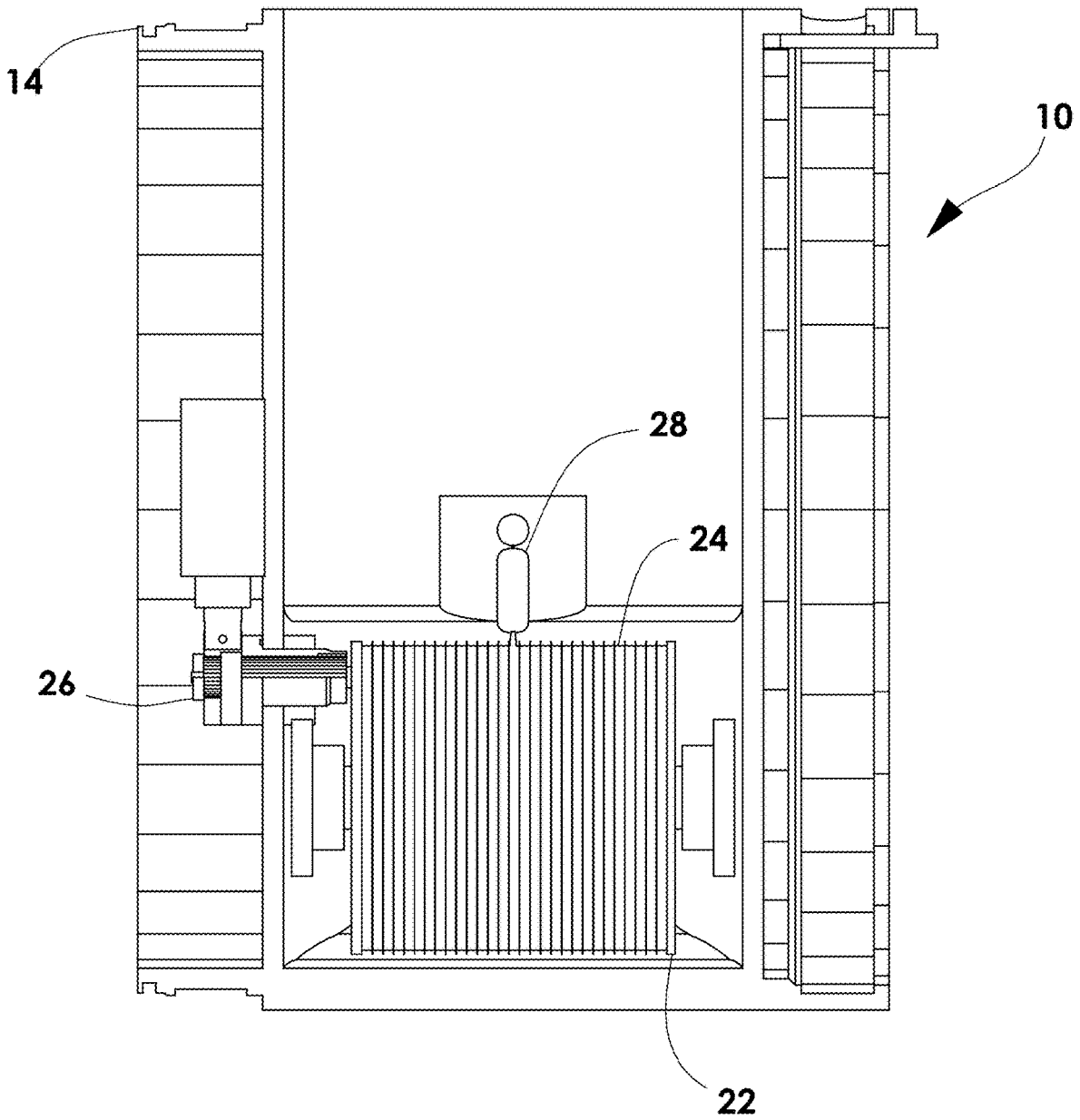
FIG. 2 depicts a side view of the torpedo recovery system of the present invention.

In FIG. 1 and in FIG. 2, the CLTRS 10 includes a hull 14, a float 18, a spool 22, high strength wire 24, a spool locking assembly 26, an extension spring 28, low friction sleeve bearings 30, a spool shaft 32, shaft mounting collars 34, a lower cover 36, and a torsion spring 38.

The aluminum hull 14 has at least one male joint 40 and at least one female joint 42 on each end in which the joints are identical to those of the host vehicle (not shown). This arrangement of the male joint 40 and the female joint 42 allows for the attachment of the CLTRS 10 along the length of the host vehicle to achieve adequate weight and trim of the host vehicle. An adapter ring 44, which adds one-half of an inch to the length of the vehicle, could be added if different joint configurations are required (i.e., male-male).

A vertically orientated oval aperture penetrates the hull 14 at the two positions (preferably at six and twelve o'clock) and is lined with a watertight pressure sleeve 48. The oval hole or aperture can be flooded with seawater while the rest of the hull 14 can be dry. The oval hole accommodates the float 18, the spool 22, the high strength wire 24, the spool shaft 32, the extension spring 28, the sleeve bearings 30 and the cover 36. The upper part of the oval hole contains the float 18 which is contoured to the shape of the hull 14 and the locking part of the spool locking assembly 26. Only one hole penetrates the wall of the watertight pressure sleeve 48 to accommodate the spool locking assembly 26. This hole is sealed with an O-ring in the spool locking assembly 26.

The aluminum spool 22 is preferably three inches in length and has a three inch diameter with a pattern of holes or apertures equally spaced on one side face to accommodate a locking pin of the spool locking assembly 26. The spool 22 rotates on low friction, high strength plain sleeve bearings 30. The bearings 30 are selected to have very low moisture absorption and to perform well in seawater.

The high-strength braided stainless steel or titanium, wire 24 is wound on the spool 22 for a high strength connection. A high strength connection is needed as this connection will ultimately transfer the lifting load (lightweight torpedo) from the wire 24 to the host vehicle. The length of the wire 24 needed is then coiled onto the spool 22 and terminates with a strain-relieved, robust mechanical connection to the extension spring 28.

The extension spring 28 is attached to an eyelet 52 on the underside of the syntactic foam float 18 via a stainless steel anchor that is cast well inside the float. The extension spring 28 allows compliance for take-up of the spool 22. This permits the locking pin to mate with one of the holes in the spool 22 and adds a pre-tension to the wire 24 and the float 18 to keep both tightly wound.

The medium density syntactic foam float 18 is pre-cast or machined as an oval to fit into the oval hole with sufficient clearance as to allow the float to move linearly out of the hole when needed but tight enough as to not allow excessive movement when stowed. The float 18 is also shaped to conform to the shape of the outer hull.

The float 18 is retained in or on the hull with the spool locking assembly 26 which also locks the spool 22 in place. After receiving an electrical signal from the host vehicle upon vehicle shutdown; the spool locking assembly 26 retracts the locking pin to free the spool 22 from a rotational constraint.

The buoyancy of the float 18 translates into wire tension; thereby, pulling the high strength wire 24 from the spool 22 with the float and extension spring 28 continuing to the water surface. The initial unspooling of the high strength wire 24 from the spool 22 is assisted by the torsion spring 38 attached to the spool shaft 32.

Once the float 18 reaches the water surface; the float provides a visual location of the host vehicle. The float 18 can then be retrieved with the float and the extension spring 28 removed from the high strength wire 24 and then coiled on a winch (not shown). The winch then slowly lifts the lightweight torpedo to the water surface for recovery without the use of divers or robotic recovery vehicles. Once on the water surface, the torpedo is retrieved similar to current retrieval processes.

The advantages of the novel recovery system of the present invention over existing recovery systems are numerous. The CLTRS 10 is a lightweight and compact design which is only one third the length of current designs and adds only six inches of shell length. Shorter hull length, thinner hull thickness and fewer components contributes to a significant reduction in weight over existing recovery systems.

Furthermore, the recovery system of the present invention has a much safer operation than existing recovery systems in that the inventive system does not require explosive rated, hot gasses nor high-pressure air flasks.

Additionally, the recovery system has increased lifting capacity which can lift as much as three times the lifting capacity of current recovery systems. The recovery system also has less complicated internal workings with a simple float/spool design in place of explosive triggering mechanisms, depth compensating, regulator valves, pressure transducers and bag deployment. Also, the parts for the novel recovery system are easier to produce and maintain.

The simple design of the recovery system of the present invention allows for a quick and easy turnaround for the next mission. All that is needed is to install a new spool (possibly from the winch that winched the spool up out of the water); pre-tension the wire; and re-set the locking pin such that the recovery system is operational. Current designs require a number of safety procedures before the recovery system can be reset or reloaded. Buoyancy bags need to be deflated, folded, and stowed; doors or new housings need to be re-installed.

The novel recovery system of the present invention has a more reliable and less complicated design. Fewer parts and a simpler design reduce the risk of malfunction. Current recovery systems use complicated depth pressure adjusting valves as to not over-inflate and rupture the bags, pressure transducers, check valves and many other fittings that are susceptible to failure.

Additionally, the novel recovery system is not sensitive to the time that it takes to retrieve the vehicle. Current buoyancy systems are actually set to scuttle themselves if not retrieved after a period of time.

Alternatives to the recovery system are current buoyancy systems which use hot gas generation or highly compressed nitrogen gas to inflate a buoyancy bag. These systems are very expensive, dangerous and prone to failure due to their complexity. Another alternative is to create a vehicle to be positively buoyant to float to the surface on its own. However, such a design creates excessively long vehicles which may be undesirable.

It will be understood that many additional changes in details, materials, steps, and arrangements of parts which have been described herein and illustrated in order to explain the nature of the invention, may be made by those skilled in the art within the principle and scope of the invention as expressed in the appended claims.

What is claimed is:

1. A compact and lightweight system for vehicle recovery, said system comprising:

an aluminum hull with at least one male joint and at least one female joint on each end in which said least one male joint and at least one female joint are capable of mating with the hull of the host vehicle;

at least two vertically-orientated apertures within said aluminum hull with each said aperture lined with a watertight pressure sleeve;

a float section encompassed by said aluminum hull with said float section including an anchor with an eyelet cast into an underside of said float section;

a spool having a spool shaft and having a locking assembly of a plurality of apertures and a locking pin with said spool affixed in said float section;

a plurality of low friction, high strength plain sleeve bearings rotationally encompassing said spool shaft;

a length of lifting wire coiled around and secured to said spool;

an extension spring having a first end and a second end with the first end of said extension spring connected to an end of said length of lifting wire and with the second end connected to said eyelet wherein said extension spring allows compliance for take-up of said spool thereby allowing said locking pin to mate with one of said apertures in said spool to add a pre-tension to said wire and said float; and a torsion spring affixed to said spool shaft with said torsion spring capable of initiating an unspooling of said wire from said spool;

wherein upon receiving an electrical signal from the host vehicle, said locking pin is retracted to free said spool from a rotational constraint and wherein a buoyancy of said float section will then translate into wire tension to pull said wire from said spool with the float and extension spring continuing to the water surface.

2. The system in accordance with claim 1, wherein said at least two vertically-orientated apertures are oval.

3. The system in accordance with claim 2 wherein said spool is aluminum and wherein said spool is three inches in length and has a three inch diameter with a pattern of apertures equally spaced on one side face to accommodate a locking pin of said spool locking assembly.

4. The system in accordance with claim 3, further comprising an adapter ring wherein said adapter ring is capable of adding one-half inch of length if different joint configurations are required.

5. The system in accordance with claim 4, wherein said lifting wire is stainless steel.

6. The system in accordance with claim 4, wherein said lifting wire is titanium.

* * * * *